US005348064A

United States Patent [19]

Nettles et al.

[11] Patent Number: 5,348,064

[45] Date of Patent: Sep. 20, 1994

[54] REVERSIBLE KNIFE HOLDER FOR CHIPPER

[75] Inventors: Timothy P. Nettles, Carthage; Scott J. Boliver, Croghan; Mark D. Robinson, Black River, all of N.Y.

[73] Assignee: Carthage Machine Company, Carthage, N.Y.

[21] Appl. No.: 116,612

[22] Filed: Sep. 7, 1993

[51] Int. Cl.[5] ..... B27C 1/00; B02C 18/18

[52] U.S. Cl. ..... 144/176; 144/162 R; 144/241; 241/92; 241/298

[58] Field of Search ..... 144/162 R, 172, 174, 144/176, 218, 230, 229, 241; 241/92, 298

[56] References Cited

U.S. PATENT DOCUMENTS

| | | |
|---|---|---|
| 733,691 | 7/1903 | Baker . |
| 999,014 | 7/1911 | DeLaney . |
| 2,388,799 | 11/1945 | Payzer et al. . |
| 3,000,578 | 9/1961 | Riches et al. . |
| 3,542,302 | 11/1970 | Salzmann . |
| 4,009,742 | 3/1977 | Ziegelmeyer . |
| 4,213,572 | 7/1980 | Pallmann . |
| 4,271,882 | 6/1981 | Valo . |
| 4,298,044 | 11/1981 | Hansel et al. . |
| 4,396,315 | 8/1983 | Middleton . |
| 4,685,497 | 8/1987 | Mireau et al. . |
| 4,754,789 | 7/1988 | Jonsson . |
| 4,784,337 | 11/1988 | Nettles et al. . |
| 4,887,772 | 12/1989 | Robinson et al. . |
| 4,977,939 | 12/1990 | Depuy et al. . |
| 5,129,437 | 7/1992 | Nettles et al. . |

*Primary Examiner*—W. Donald Bray
*Attorney, Agent, or Firm*—Harris Beach & Wilcox

[57] ABSTRACT

A chipper employs a rotary cutting disk with a plurality of radial knife assemblies. Each knife assembly has a reversible blade of generally trapezoidal cross section. The assembly has a knife holder and a knife clamp that sandwich the blade between them. An elongated load bar is seated in a recess in the clamp and supports a sloping surface at a concealed edge of the blade.

10 Claims, 4 Drawing Sheets

REVERSIBLE KNIFE HOLDER FOR CHIPPER

BACKGROUND OF THE INVENTION

The present invention relates to knife assemblies for disk-type chippers, and in particular to a knife assembly that can employ reversible blades.

Chippers of this type are well known, and examples are found in U.S. Pat. No. 4,784,337 to Nettles et al. and in U.S. Pat. No. 4,887,772 to Robinson et al. Those chippers are of the well-known Carthage-Norman design in which a vertical disk rotates upon a horizontal drive shaft. The disk is covered by a housing with a removable hood and a spout or feeder projects from the housing for guiding logs into contact with the rotating disk. The logs are supplied, generally end-on, to a series of radially disposed knives carried on the disk. The knives are clamped in place at cutting stations around the disk, and chip slots or passages through the disk are situated at the cutting stations adjacent the knife blades. The wood chips cut from the logs move through the passages and are ejected from the machine via a casing discharge area. The spout or feeder has a stationary bedknife that cooperates with the rotary knives so that the logs are cut into uniform chips suitable to be processed, e.g. in the digester of a wood pulping machine.

The blades of the knife assemblies are the parts most subject to wear. For this reason good blade design principles should include ease of replacement and relatively low replacement cost, together with means to extend the blade wear life. When the blades become worn they are resharpened by grinding off material, and then are replaced and adjustments made to achieve proper positioning. The blades must be secured and firmly supported in the knife holder.

Reversible knives have been employed as a step in reducing machine down time and knife cost. A number of reversible blade arrangements have been proposed, and two of these are found in U.S. Pat. No. 4,669,516 to Carpenter et al. and in U.S. Pat. No. 4,047,670 to Svensson. Carpenter employs a V-shaped cross-section knife while Svensson employs a Z-shaped cross-section knife. These each have angularly disposed cutting surfaces that make the blade extremely difficult to grip and support during assembly. The knives are clamped down by a clamp bar or hold-down plate, these being rather precisely machined so that their profiles exactly match those of the knife blades that they support. Due to the odd configuration, the blades are expensive to manufacture and can be rather difficult to sharpen. The center waist or bend in the knife blade constitutes a weak sector, but is also near the place of maximum mechanical stress. Thus, these blades are subject to an accelerated rate of failure under load. Consequently both the initial cost of a chipper using these reversible knives and their cost of maintenance and operation remain relatively high.

Holmberg et al. U.S. Pat. No. 4,694,995 employs a knife cassette with a Z-cross section blade clamped down by a profiled knife holder.

Disposable knife blade assemblies have also been proposed in which the conventional resharpenable chipper knife is replaced with an adapter or cassette knife assembly. This can be comprised of a two-part knife blade, a cassette, and a hold-down top plate. One such assembly is described in U.S. Pat. No. 4,784,337. In that assembly a reversible, double-edge knife blade fits an elongated cassette that has a blade-receiving recess.

In that case the blade has a keyway or cutout on its underside that mates with a rib or key on the cassette. The knife is held in place with a retaining bar, so that one edge is exposed and the other edge is covered. Adjustment of blade position is achieved by babbitting at the back surface of the cassette. Here, the cutouts or keyways can have a weakening effect, and because they must be machined rather precisely, they raise the manufacturing cost of the knife blades. However, with that system it is not possible to employ a flat blade.

In U.S. Pat. No. 4,878,772, a cassette type knife is employed, where a reversible blade is supported in a cassette which is a stepped member with surfaces supporting a flat side and one sloping side of the knife blade. The entire cassette can be fastened in place in the blade holder of the chipper disk. Generally, the cassette and blade have to be babbitted to adjust to the correct cutting depth.

OBJECTS AND SUMMARY OF THE INVENTION

Accordingly, one object of this invention is to provide chipping apparatus with a reversible double-edge knife blade, and which overcomes the drawbacks of the prior art.

It is another object of this invention to provide a chipping apparatus with a simple, compact knife assembly having a knife blade that can be easily reversed or replaced, as need be, and which can be easily adjusted.

In accordance with an aspect of this invention a chipper or chipping machine cuts logs into wood chips which can then be processed in a digester or other processor. A rotary cutting disk has several radially elongated knife assemblies in respective cutout in the proximal face of the disk, with each knife assembly being disposed adjacent an entrance to a respective chip slot. The wood chips can pass axially through this slot to the distal side of the disk, where they can be discharged into a bin for a subsequent processing.

In the knife assembly, a reversible double-edge knife blade has a non-rectangular, i.e., trapezoidal or parallelogram cross section, with upper and lower parallel surfaces and first and second sloping surfaces that each lead to a respective edge. One of the edges is exposed for cutting the wood, and the other is hidden and is in reserve. A knife holder base secures into each of the cutouts on the disk. This knife holder base has a ramp surface that supports a flat lower surface of the knife blade. A recess is formed adjacent the ramp surface and extends away from this surface to a step or shoulder. A load bar is positioned in this recess and has one edge surface abutting the shoulder of the knife holder base, and an opposite edge surface supporting one of the sloping surfaces of the knife blade. A knife holder clamp removably secures the blade against the knife holder base and load bar, with a portion of the clamp bearing against the upper surface of the blade. The knife holder base can be secured by a threaded stud to the disk, and the clamp can be secured by a screw or bolt to the base from the front face of the disk. Alternatively, a stud can pass through the disk and base into the knife holder clamp, and can be secured by a nut on the distal or discharge side of the disk.

In some embodiments, the recess for the load bar extends in the plane, i.e., the turning direction of the disk. In other possible embodiments the load bar recess can extend in the direction of the ramp surface, but recessed below it.

The load bar can be ground or machined as need be to position the associated knife blade so that the exposed edge of the blade is in proper relationship to the bed-knife.

In other embodiments an additional knife blade can be sandwiched between this knife blade and the knife holder base to serve as a counter knife. This counter-knife absorbs wear from the wood chips entering the chip slot. The counter knife blade can have the same construction as the cutting blade, and in fact can preferably be a knife blade that has been previously used. This extends the life of the blade by having the blade serve a term as counter knife rather than scrapping it.

The above and many other objects, features, and advantages of this invention will present themselves to the person skilled in the art upon reading the ensuing description of the preferred embodiments, which are to be considered in connection with the accompanying Drawing.

DETAILED DESCRIPTION OF THE PREFERRED EMBODIMENT

Figure 1:
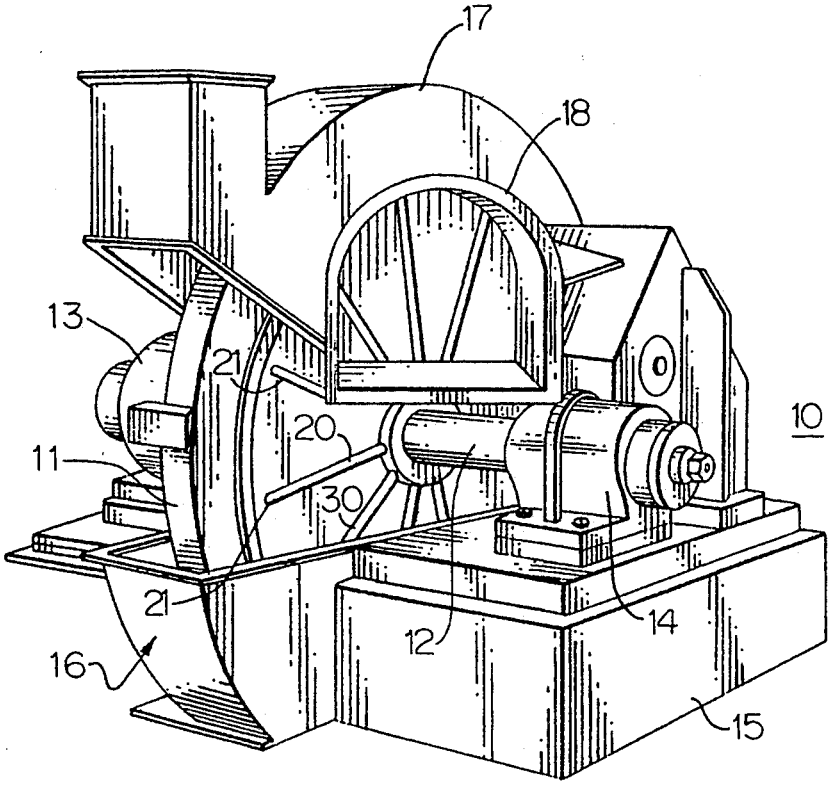
FIG. 1 is a perspective view of a chipper which employs the knife assembly according to an embodiment of this invention.
Figure 2:
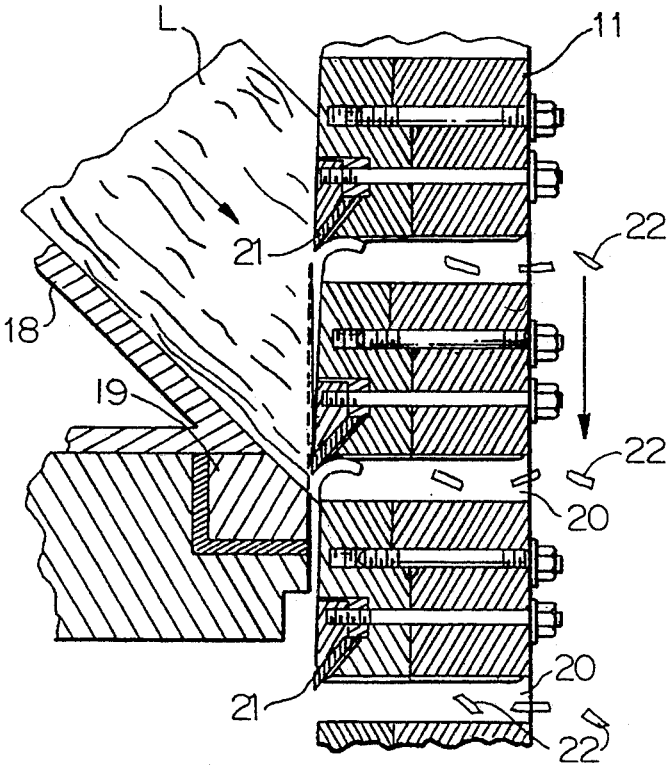
FIG. 2 is a sectional view of a portion of a chipper disk showing knife assemblies of one embodiment of the invention.

Referring to the Drawing, and initially to FIGS. 1 and 2, a large vertical-disk type log chipper 10 can be of the well-know Carthage Norman design, as described e.g. in U.S. Pat. No. 4,784,337. The chipper has a large rotary disk 11 supported on a horizontal axle 12 driven by an electric motor 13. The axle 12 is supported on bearings 14 that rest on a base 15. The disk 11 is enclosed in a housing that consists of a lower enclosure 16 and an upper enclosure 17, here shown partly raised to reveal the disk 11. A log chute 18 or spout is incorporated into the upper housing and brings logs end-on into contact with the chipper disk 11.

Distributed about the disk 11 are between three and fifteen cutting stations each defined by a more-or-less radially extending chip slot 20. At each of the cutting stations there is a knife assembly 21 that extends radially the length of the chip slot 20. The chip slot passes axially through the disk from the front side, where logs are encountered, to the rear side, where chips are discharged.

The disk 11 rotates within the housing. As shown in FIG. 2, a log L proceeding into the chute 18 encounters the front or cutting face of the rotary disk 11. The cutting stations rotate past, and the various knife assemblies 21 cut wood chips 22 from the log L. The knife assemblies pass a bed knife 19 at the lower edge of the chute 18, and the wood chips 22, severed from the log L proceed through the chip slot and are discharged at the distal side of the disk 11, i.e., at the right in FIG. 2.

Figure 3:
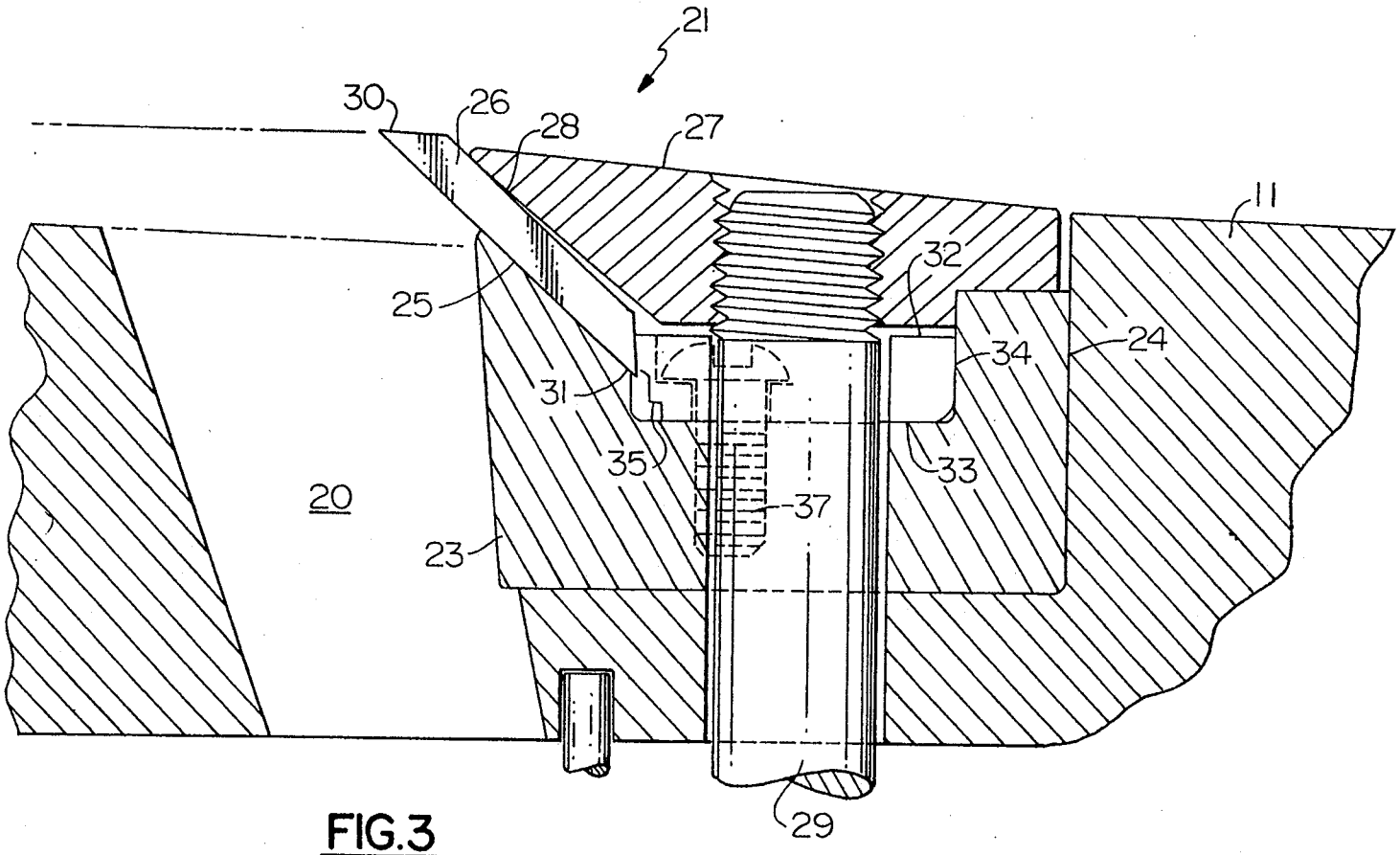
FIG. 3 is an enlarged sectional view showing a knife assembly according to one preferred embodiment.

FIG. 3, shows detail of the knife assembly 21 of this embodiment, together with a portion of the disk 11 and the adjacent chip slot 20.

The knife assembly 21 comprises a knife holder 23 of somewhat C-shaped section that fits into a recess 24 in the disk 11. Adjacent the chip slot the knife holder 23 has a sloping surface 25 that supports a reversible knife blade 26, here of a generally trapezoidal cross-section. A knife clamp 27 fits on the log-facing surface of the holder 23 and has a sloping surface 28 that holds the knife blade 26 in place. Here a threaded stud 29 engages female threads in the clamp 27 and draws the same against the blade and knife holder. This stud 29 also holds the knife holder 23 in place in the recess 24. In practice there are a series of these studs 29 along the length of the knife assembly, but in this view the one stud shown is representative of the group. The stud 29 passes through a bore in the knife holder 23 and a coaxial bore through the disk 11 and is retained by a nut (not shown here) on the discharge side of the disk. The configuration of the stud 29 or other retaining means can be varied widely without affecting the main principles of this invention.

The reversible knife blade 26 has two parallel surfaces, which can be considered upper and lower surfaces in FIG. 3, and a pair of sloping surfaces. These sloping surfaces meet the larger, or lower surface along opposite edges to define sharp cutting edges of the knife blade 26. The blade, being sandwiched between the holder 23 and the clamp 27, has a working, exposed cutting edge 30 and a reserve, concealed edge 31. The knife blade is reversible, and when the working edge becomes worn, the blade can be removed, by first loosening the clamp 27, and then reversing the blade, end-for-end and reinstalling. This will present the reserve edge 31 as a new cutting edge.

A load bar 32 is positioned in a recess 33 in the knife holder 23. The bar 32 is a radially elongated rigid member with a forward edge (to the left in this view) biasing against the blade 26 at the sloping surface adjacent the reserve edge 31. A trailing edge (to the right in this view) abuts a wall 34 of the recess 33. The load bar forward edge, which abuts the blade, is disposed in a plane that is at a high angle, here substantially normal, to the shear plane or rotational plane of the disk. This provides a solid, continuous load-bearing structure in the shear direction (i.e., horizontal in FIG. 3) from the blade 26 through the load bar 32 and knife holder 23 to the disk 11. Here, the stud 29 passes through a bore in the load bar 32.

The load bar can have its knife-contacting face machined so that the reserve edge 31 is out of contact with the knife holder 23 and the load bar 32. In this case there is a recess 35 in the blade contacting face, and an adjacent land 36 contacts the sloping surface of the blade 26 above the edge 31. The load bar 32 can be machined to accommodate the blade 26 after resharpening so that proper blade projection and cutting angle are maintained.

Also shown here in ghost is a load bar retaining screw 37 that engages a female thread in the knife holder 23 to hold the load bar 32 in place.

Figure 4:
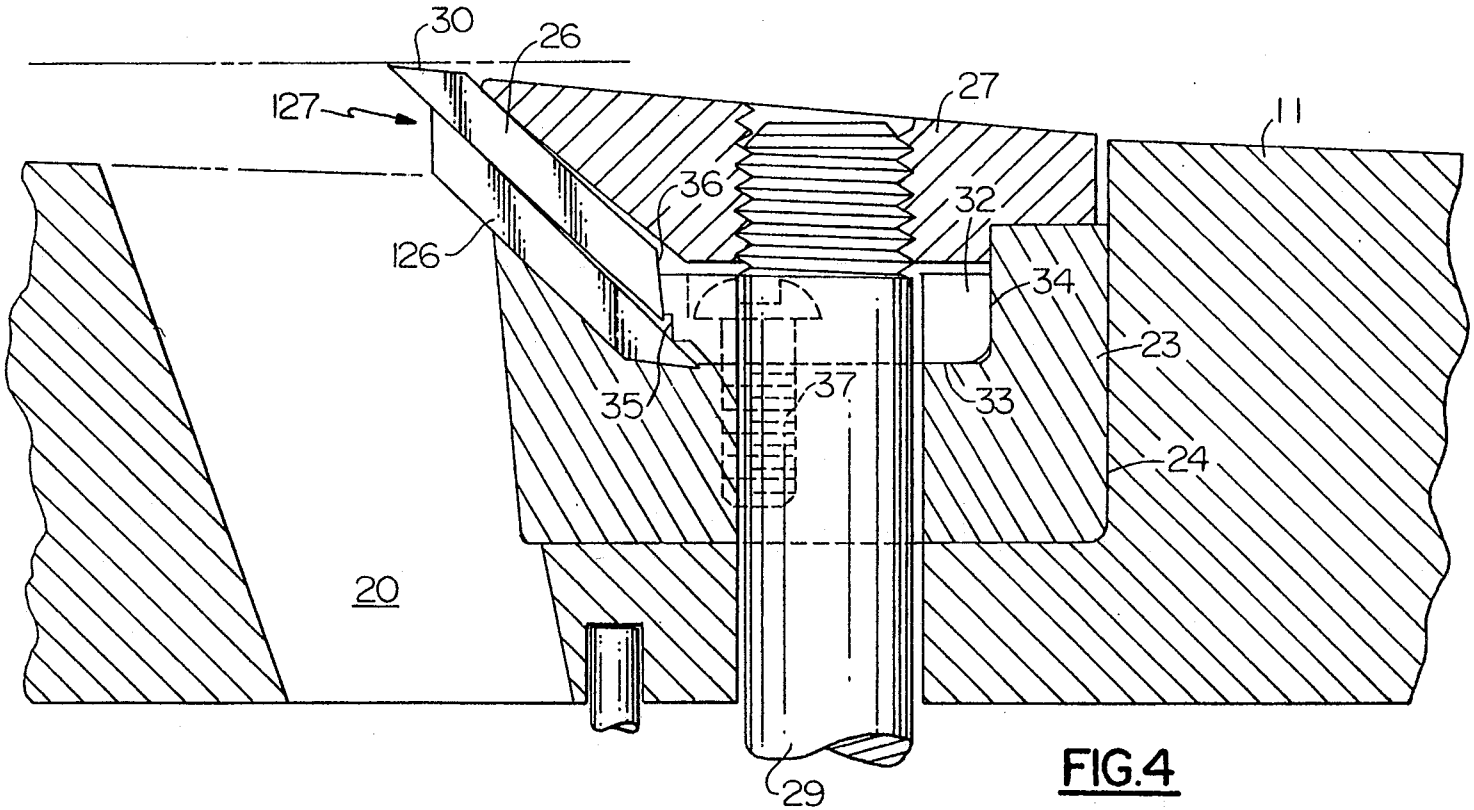
FIG. 4 is an enlarged sectional view showing an alternative knife assembly according to another embodiment.

FIG. 4 shows an alternative embodiment in which like elements are identified with the same reference characters. In this embodiment an additional knife blade 126, which can be identical to the trapezoidal cross-section blade 26, is positioned on its back relative to the other knife blade 26 and beneath the other blade. The counter knife presents one of its sloping surfaces 127 as a wear surface to absorb wear from contact with the moving wood chips, and also serves to direct the chips into the throat of the chip slot 20.

The blade 26 can serve double duty: first as a reversible cutting blade as in the FIG. 4 embodiment and then, after both edges 30 and 31 have been consumed by use, as a counter knife supporting a new cutting blade.

In this embodiment, the counter knife 126 also provides additional support to the cantilevered exposed part of the knife blade 26, avoiding some of the strain imposed on the blade by the logs.

The reversible blades of this invention, being free of bends and recesses, pass any strain they endure directly to the load bar 32. There is very small risk of stress concentrations in the blade during operation, and so there is a reduced risk of blade failure.

Figure 5:
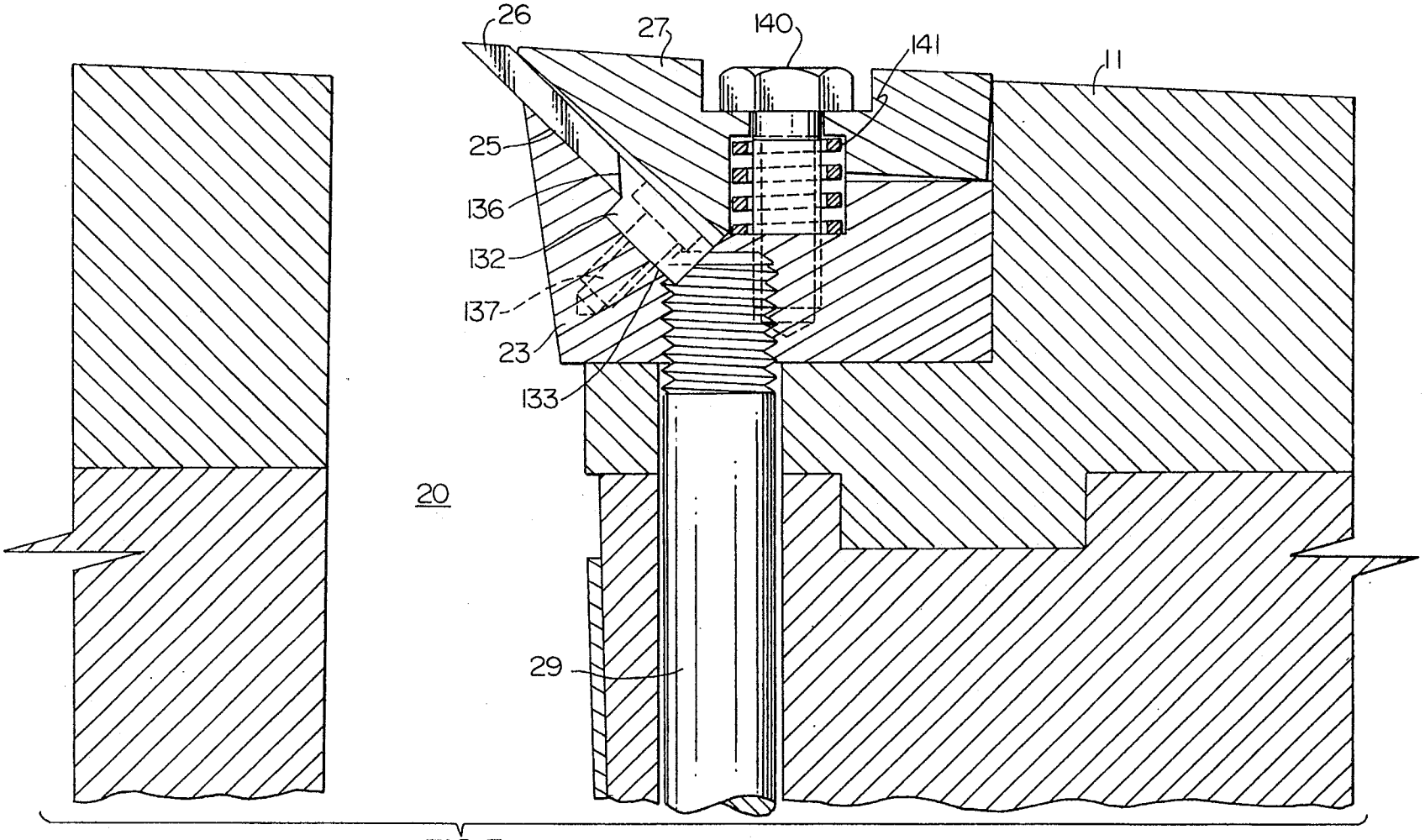
FIG. 5 is an enlarged sectional view showing a knife assembly of yet another embodiment.

A yet-further embodiment of the invention is shown in FIG. 5. Here a similar knife blade 26 is sandwiched between the ramp surface 25 of the knife holder 23 and the knife clamp 27, and is positioned adjacent the chip slot 20. In this embodiment the blade 26 is supported by a load bar 142 that is situated in a recess 133 that extends in a plane generally parallel to the ramp 25, a squared proximal surface of the load bar rests on a shoulder of the recess, and the distal edge of the load bar 132 has an undercut profile 136 that supports the sloping edge of the blade 26. A load bar hold-down screw 137 fastens the load bar 132 to the knife holder 23. An additional knife blade can be used as a counter knife, as described earlier.

Also shown in this embodiment is a knife clamp screw 140 that holds down the knife clamp 27. The screw 140 has its head accessible from the front or log side of the disk, and has a threaded shaft that engages a threaded bore in the knife holder 23. A retracting spring 141 over the screw 140 and positioned between the clamp 27 and holder 23 assists in lifting the clamp 27 to replace the blade 26.

While this invention has been described with reference to selected preferred embodiments, it should be recognized that these serve as representative examples. Many modifications and variations would occur to those skilled in the art without departing from the scope and spirit of this invention, as defined in the appended claims.

What is claimed is:

1. Apparatus for cutting logs into wood chips, including a rotary cutting disk having a rotational plane, a plurality of radially disposed knife assemblies secured into elongated cutouts in a proximal face of said rotary disk, each knife assembly being situated adjacent an entrance to a respective chip slot that passes axially through the disk, each of said knife assemblies comprising:

a reversible double-edge knife blade having a nonrectangular cross section with upper and lower parallel surfaces and first and second sloping surfaces each leading to a respective cutting edge;

a knife holder base that is secured into a respective one of the cutouts in said disk, having a ramp surface adjacent the chip slot on which the lower surface of the knife blade is supported, and a recess that extends from the ramp surface to a shoulder;

a load bar positioned in said recess having one edge surface abutting the shoulder of said knife holder base an opposite edge surface supporting one of the sloping surfaces of said knife blade, said opposite edge surface being disposed at a high angle relative to the rotational plane of the disk; and a knife holder clamp that removably secures onto said knife holder base over said load bar and that has a portion thereof biasing against the upper surface of said blade.

2. The apparatus of claim 1 further comprising a threaded stud passing through said disk and threadably secured in said knife holder base, and a nut securing said stud on the distal side of the disk.

3. The apparatus of claim 1 further comprising a threaded stud passing through said disk and said knife holder base and threadably secured in said knife holder clamp, and means securing said stud onto said disk.

4. Apparatus for cutting logs into wood chips, including a rotary cutting disk, a plurality of radially disposed knife assemblies secured into elongated cutouts in a proximal face of said rotary disk, each knife assembly being situated adjacent an entrance to a respective chip slot that passes axially through the disk, each of said knife assemblies comprising:

a reversible double-edge knife blade having a nonrectangular cross section with upper and lower parallel surfaces and first and second sloping surfaces each leading to a respective cutting edge;

a knife holder base that is secured into a respective one of the cutouts in said disk, having a ramp surface adjacent the chip slot on which the lower surface of the knife blade is supported, and a recess that extends from the ramp surface to a shoulder;

a load bar positioned in said recess having one edge surface abutting the shoulder of said knife holder base and an opposite edge surface supporting one of the sloping surfaces of said knife blade;

a knife holder clamp that removably secures onto said knife holder base over said load bar and that has a portion thereof biasing against the upper surface of said blade;

a threaded stud member having a head secured in said load bar and passing through the load bar, the knife holder base, and the disk; and means securing said stud member onto said disk.

5. Apparatus for cutting logs into wood chips, including a rotary cutting disk, a plurality of radially disposed knife assemblies secured into elongated cutouts in a proximal face of said rotary disk, each knife assembly being situated adjacent an entrance to a respective chip slot that passes axially through the disk, each of said knife assemblies comprising:

a reversible double-edge knife blade having a nonrectangular cross section with upper and lower parallel surfaces and first and second sloping surfaces each leading to a respective cutting edge;

a knife holder base that is secured into a respective one of the cutouts in said disk, having a ramp surface adjacent the chip slot on which the lower surface of the knife blade is supported, and recess that extends from the ramp surface to a shoulder, wherein said recess in said knife holder base extends in a shear plane generally perpendicular to the axis of the disk;

a load bar positioned in said recess having one edge surface abutting the shoulder of said knife holder base and an opposite edge surface supporting one of the sloping surfaces of said knife blade, and wherein said load bar is shaped to lie on said shear plane with said one edge against the shoulder of the recess and the opposite edge against the sloping surface of the knife blade; and a knife holder clamp that removably secures onto said knife holder base over said load bar and that has a portion thereof biasing against the upper surface of said blade.

6. The apparatus of claim 1 wherein said recess extends generally in a plane parallel to said ramp surface, and said load bar has said opposite edge shaped to have an undercut profile to support said sloping surface of the knife blade.

7. The apparatus of claim 1, further comprising an additional knife blade of trapezoidal cross section disposed between the lower surface of the first-mentioned knife blade and said knife clamp base ramp surface, the additional knife blade serving as a counterknife to absorb wear from wood chips entering said chip slot.

8. Apparatus for cutting logs into wood chips, including a rotary cutting disk, and a plurality of radially disposed knife assemblies secured into elongated cutouts at a proximal side of said rotary cutting disk, each knife assembly being situated adjacent an entrance to a respective chip slot that passes axially through the disk, each of said knife assemblies comprising:

a reversible double-edge knife blade having a nonrectangular cross section with upper and lower parallel surface and first and second sloping surface each leading to a respective cutting edge;

a knife holder base that is disposed at a respective one of said cutouts in said disk, having a ramp surface adjacent the respective chip slot and defining a recess that extends to a shoulder;

a load bar positioned in said recess and including means abutting the shoulder of said knife holder base and means on an opposite edge adjacent said knife blade supporting one of the sloping surfaces of said knife blade and disposed at a high angle relative to a rotational direction of said cutting disk; and a knife holder clamp that releasably secures said reversible blade and said load bar in said recess between said knife holder clamp and said knife holder base.

9. Apparatus for cutting logs into wood chips, including a rotary cutting disk, a plurality of radially disposed knife assemblies secured into elongated cutouts in a proximal face of said rotary disk, each knife assembly being situated adjacent an entrance to a respective chip slot that passes axially through the disk, each of said knife assemblies comprising:

a reversible double-edge knife blade having a nonrectangular cross section with upper and lower parallel surfaces and first and second sloping surfaces each leading to a respective cutting edge;

a knife holder base that is secured into a respective one of the cutouts in said disk, having a ramp surface adjacent the chip slot on which the lower surface of the knife blade is supported, and a recess that extends from the ramp surface to a shoulder;

a load bar positioned in said recess having one edge surface abutting the shoulder of said knife holder base and an opposite edge surface supporting the first sloping surface of said knife blade, said opposite edge surface including a land to contact said blade sloping surface and an adjacent recess such that the cutting edge at the first sloping surface of said blade is held out of contact with the knife holder base and the load bar; and a knife holder clamp that removably secures onto said knife holder base over said load bar and that has a portion thereof biasing against the upper surface of said blade.

10. Apparatus for cutting logs into wood chips, including a rotary cutting disk, a plurality of radially disposed knife assemblies secured into elongated cutouts in a proximal face of said rotary disk, each knife assembly being situated adjacent an entrance to a respective chip slot that passes axially through the disk, each of said knife assemblies comprising:

a reversible double-edge knife blade having a nonrectangular cross section with upper and lower parallel surfaces and first and second sloping surfaces each leading to a respective cutting edge;

a knife holder base that is secured into a respective one of the cutouts in said disk, having a ramp surface adjacent the chip slot on which the lower surface of the knife blade is supported, and a recess that extends from the ramp surface to a shoulder;

a load bar positioned in said recess having one edge surface abutting the shoulder of said knife holder base an opposite edge surface supporting one of the sloping surfaces of said knife blade;

a load bar retaining screw which passes through the load bar and engages a female thread in the knife holder base to hold the load bar in place; and a knife holder clamp that removably secures onto said knife holder base over said load bar and that has a portion thereof biasing against the upper surface of said blade.

* * * * *